United States Patent [19]

Thuaud

[11] 4,139,912

[45] Feb. 20, 1979

[54] PROTECTIVE HAIRDRESSING CAPE

[76] Inventor: Robert A. Thuaud, 3 rue Francois Luneau, 44330 Vallet, France

[21] Appl. No.: 802,952

[22] Filed: Jun. 2, 1977

[30] Foreign Application Priority Data

Jun. 23, 1976 [FR] France ..... 76 19036

[51] Int. Cl.[2] ..... A41D 25/00

[52] U.S. Cl. ..... 2/50

[58] Field of Search ..... 2/207, 50, 49, 273, 2/174; 132/45, 3 B, 9

[56] References Cited

U.S. PATENT DOCUMENTS

| | | | |
|---|---|---|---|
| 1,084,233 | 1/1914 | Roarke | 2/273 |
| 1,741,060 | 12/1929 | Levenson | 2/273 |
| 2,808,840 | 10/1957 | DeSanti | 132/45 R |
| 2,936,767 | 5/1960 | McDonough | 132/45 R |
| 3,935,870 | 2/1976 | Wall | 132/45 R |

FOREIGN PATENT DOCUMENTS

| | | | |
|---|---|---|---|
| 13353 | 6/1906 | Fed. Rep. of Germany | 24/9 |

*Primary Examiner*—Werner H. Schroeder
*Assistant Examiner*—Doris L. Troutman

[57] ABSTRACT

A protective hair dressing cape made from a flexible, crease-resistant plastic sheet and comprising a back portion which covers at least the upper part of the back and the shoulders of the wearer, a collar which defines the upper part of said back portion and corresponds and is adapted to the shape of the neck in a substantially tight manner, two side flaps forming the extension of said back portion on the shoulders and towards the chest and a device for holding it in place on the body of the wearer.

The maintaining in position device comprises at least one weight which can be joined to the flaps and forms a counterweight for the cape relative to the shoulders.

The cape can be fitted to the wearer with the greatest possible ease.

10 Claims, 9 Drawing Figures

FIG. 3
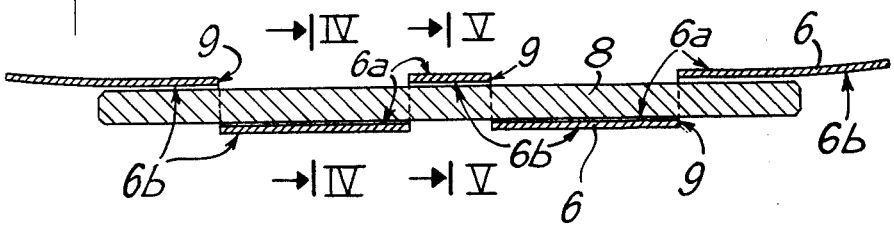
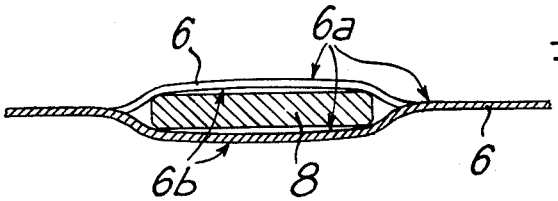
FIG. 4
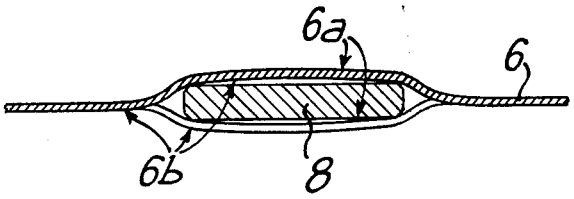
FIG. 5
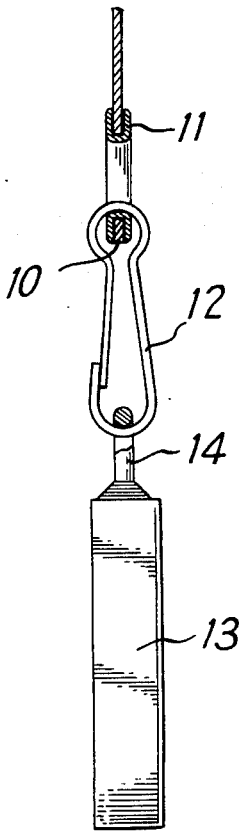
FIG. 8

PROTECTIVE HAIRDRESSING CAPE

BACKGROUND OF THE INVENTION

Hairdressers use protective clothing which protects the clothing of the person whose hair they are dressing. Said protective clothing includes capes which cover the top of the back, the chest and the shoulders and provide this protection throughout the various hairdressing operations, particularly hair cutting.

The latest and best of these capes are made from a flexible, crease-resistant material, so that they satisfactorily adapt to the body of the wearer and also offer the points of the scissors used a smooth surface upon which they cannot become caught.

It is naturally necessary to maintain the cape in position on the shoulders of the wearer, so that it does not drop off and so that it stays in a satisfactory position. The latter point is particularly important in the case of capes whose visible rear portion is provided with hairdressing guide lines. The known devices for holding the capes in place do not satisfy the requirements of professional hairdressers and the invention proposes a new cape to satisfy this need.

BRIEF SUMMARY OF THE INVENTION

The invention consequently relates to a protective cape for use when cutting the hair and made from a smooth sheet of a flexible, crease-resistant material, such as a plastic sheet comprising:

- a back portion which covers at least the upper part of the back and shoulders of the wearer and whose visible surface optionally carries a system of hair cutting guide lines;
- a collar which defines the upper part of the back portion, corresponds to the shape of the neck and adapts thereto in a substantially tight manner;
- two side flaps forming the extension of the back portion on the shoulders and extending towards the chest of the wearer; a device for maintaining the cape in position on the wearer.

The maintaining in position device comprises at least one weight which can be joined to the flaps and forms a balancing counterweight for the cape relative to the shoulders.

In a preferred manner the weight comprises two auxiliary masses, one being joined to one flap and the other to the other flap.

In this case each auxiliary mass advantageously comprises either a plate fixed to the corresponding flap and contiguous therewith or a type of medallion connected to the corresponding flap by a deformable link, such as a hook inserted in an eyelet on the flap.

The weight can also comprise a type of medallion suspended on the central part of a flexible link, such as a chain or strap, whereby the ends of said link are attached in one case to one of the two flaps and the other to the other flap, one of which is attached in a detachable manner.

In per se known manner the visible surface of the back portion sometimes carries a system of guide lines. In this case the maintaining in position device also comprises a device for regulating the perpendicularity of the cape, permitting it to be maintained in the position where said system of guide lines can be used.

In a preferred manner the perpendicularity regulating device comprises reference marks carried by the back portion and which must be maintained in the configuration of use of the cape, in its vertical plane of symmetry, and by a plumb line which is attached to the rear part of the back portion and in this configuration of use it is also contained in said vertical plane of symmetry.

The reference marks advantageously consist of the vertical median line of the back portion.

BRIEF DESCRIPTION OF THE DRAWINGS

The invention will be better understood and its secondary features and their advantages will become more apparent from the following illustrative and non-limitative description, with reference to the drawings, wherein show:

FIG. 3 a section along the line III—III of FIG. 2.

FIG. 4 a section along the line IV—IV of FIG. 3.

FIG. 5 a section along the line V—V of FIG. 3.

FIG. 8 a section according to line VIII—VIII of FIG. 7.

DETAILED DESCRIPTION OF THE PREFERRED EMBODIMENTS

Figure 1:
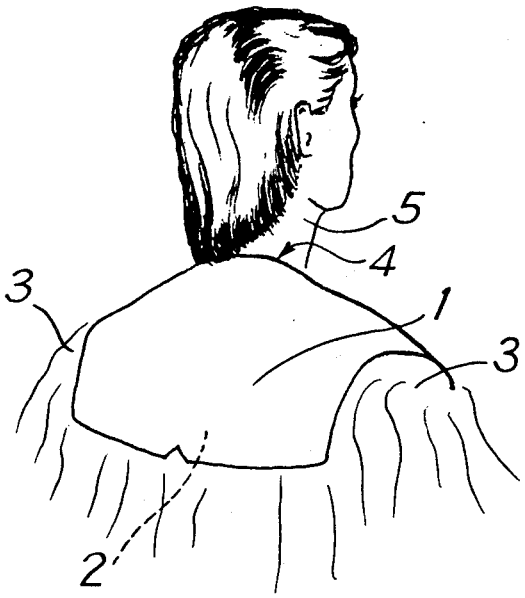
FIG. 1 a perspective view showing the rear surface of the cape according to the invention in the position of use.
Figure 2:
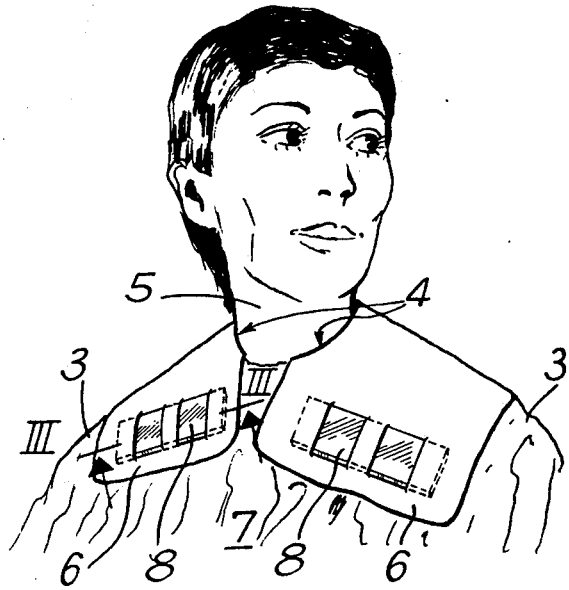
FIG. 2 a perspective view showing the front surface of the cape of FIG. 1.

The cape of FIGS. 1 to 5 is made from a sheet of smooth, crease-resistant plastic comprising:

- a back portion 1 covering the upper part 2 of the back and the shoulders 3 of the wearer;
- a collar 4 defining the upper part 2 of back portion 1 and which is adapted to the shape of the neck 5 of the wearer in a substantially tight manner;
- two side flaps 6 forming an extension of back portion 1 on the shoulders 3 and towards the chest 7 of the wearer, whose upper area they cover; two weights 8, one of which is fixed to one of the flaps 6 and the other to the other flap, forming balancing counterweights for the weight of back portion 1 relative to the shoulders 3.

Each flap 6 shown has four incisions 9 permitting the passage of the corresponding mass 8 in the form of a metal plate, alternately above the upper surface 6*a* of the flap and below the lower surface 6*b* of said flap. Mass 8 is held in place by the elasticity of the cape material.

Figure 6:
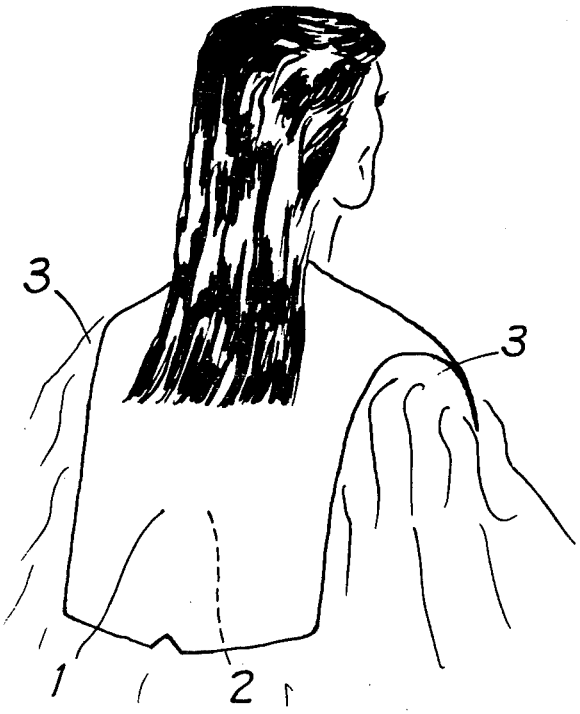
FIG. 6 a perspective view showing the rear surface of a variant of the cape of FIGS. 1 and 2.
Figure 7:
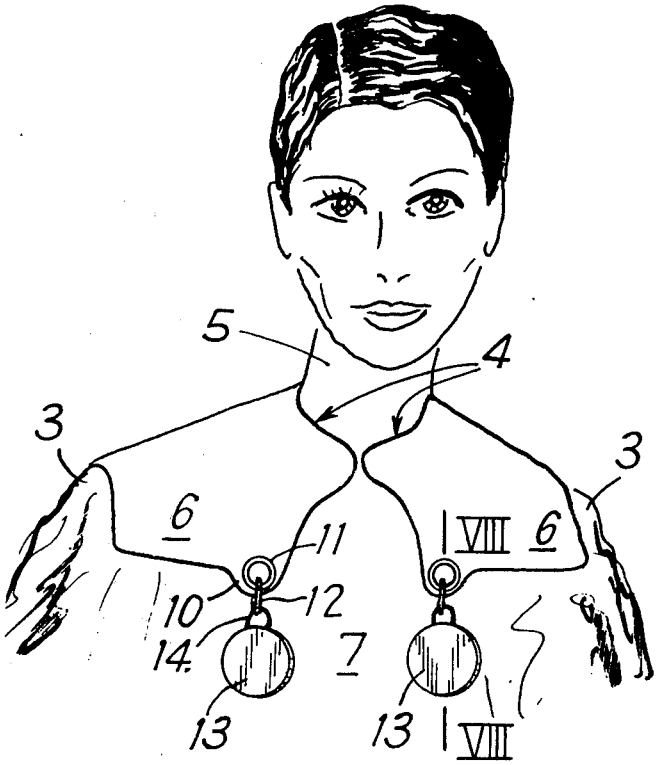
FIG. 7 a perspective view of the front surface of the cape of FIG. 6.

The cape of FIGS. 6 to 8 is fundamentally of the same design that described hereinbefore, except for the masses 8. The inside corner 10 of each flap 6 has an eyelet 11, into which is inserted a snap hook 12. On hook 12 is suspended a medallion 13 forming a weight by means of a ring 14 welded to said medallion.

Figure 9:
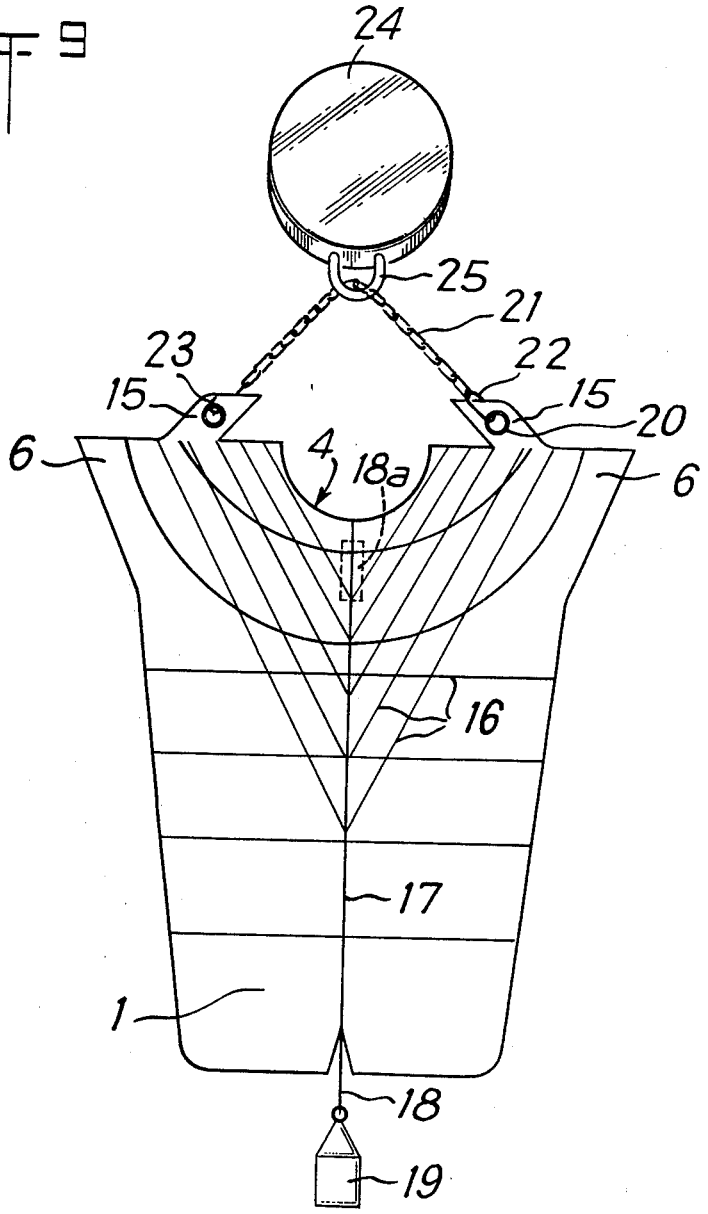
FIG. 9 a plan view of another variant of the cape of FIGS. 1 and 2.

Finally the cape can be of the type shown in FIG. 9. On the outer surface of the cape specifically the surface of back portion 1, are drawn several curved or straight lines 16 corresponding to various hair styles. Said cape is symmetrical relative to line 17 which is positioned vertically due to a plumb line 18 equipped with its plumb 19.

The cape of FIG. 9 is also remarkable due to its main position maintaining device. A strap 15 is integral with each flap 6 and is provided with an eyelet 20. A chain 21 is attached by one of its ends 22 to one of the eyelets 20 in a permanent manner and by its other end, which is shaped into a hook 23 to the other eyelet 20 in a detachable manner. Finally, a medallion 24 forming a weight and constituting a counter-weight to back portion 1 is attached to chain 21 by means of a ring 25, which is integral therewith and into which passes said chain 21.

The following are the advantages of the capes described hereinbefore.

Firstly all of them have a device for maintaining the protective back portion 1 in position on the back 2 and shoulders 3 and which is both effective and simple. It is very effective because the masses 8 or medallions 13 or 24 substantially balance out the weight of the back portion 1, so that it no longer tends to slip and fall. It is simple as regards the design of the uncomplicated masses joined to flaps 6 and as regards its use, whereby it is merely necessary to fit the flaps 6 and masses 8 or medallions 13 or 24, there being no need to tie laces and the like. It should be noted that the shape of collar 4 corresponds to that of the neck 5, so that the former can easily be placed round the latter without any length adjustment being necessary.

Masses 8 are advantageous for small and medium sized capes, whilst medallions 13 or 24 are generally preferred for larger capes.

Finally when hair cutting and dressing guide lines 16 are provided vertical line 17 must obviously be made to coincide with the backbone of the wearer in order to permit symmetrical cutting. Plumb line 18 or any similar system (e.g. spirit level) permits the adjustment of the cape equipped therewith.

The following points should also be noted:

The cape made from a 1–4 mm thick plastic sheet could also be made from rubber or a similar material.

Plumb line 18 can be fixed by one of its ends 18*a*, as shown, to the upper part of back portion 1, close to collar 4, by means for example of a small tongue stuck to the cape.

The case of fitting the cape saves time (about 50%, proved by tests).

Due to the large number and variety of outline of the guide lines all hair cuts and styles can be made with great precision.

The design of collar 4 and the action of masses 8 or medallions 13 and 24 permit a good matching of collar 4 to neck 5. Collar 4, without gripping the neck 5, is applied sufficiently firmly to ensure a satisfactory sealing or tightness, thus preventing the passage of small hairs and the trickling of water on the neck.

The invention is not limited to the embodiments described hereinbefore and covers all the variants which can be made thereto without passing beyond the scope of the invention.

What is claimed is:

1. A protective cape for use when cutting the hair of a wearer and made from a smooth sheet of a flexible, crease-resistant material, such as a plastic sheet, comprising:

a back portion which covers at least the upper part of the back and shoulders of the wearer;

a collar which defines the upper part of the back portion, corresponds to the shape of the neck of the wearer and adapts thereto in a substantially tight manner;

two side flaps forming an extension of the back portion on the shoulders and extending towards the chest of the wearer; and a device for maintining the cape in position on the wearer, said device comprising at least one weight adapted to be joined to the flaps and forming a balancing counterweight for the cape relative to the shoulders.

2. A cape according to claim 1, wherein the weight comprises two auxiliary masses, whereof one is connected to one of the flaps and the other to the other flap.

3. A cape according to claim 2, wherein each auxiliary mass comprises a plate fixed to the corresponding flap and contiguous therewith.

4. A cape according to claim 2, wherein each auxiliary mass comprises a medallion, a deformable link, said medallion respectively being connected to the corresponding flap by said deformable link.

5. A cape according to claim 4, wherein each flap is provided with an eyelet and a hook connected to said deformable link and inserted into the respective eyelet.

6. A cape according to claim 1, wherein the weight comprises a medallion, a flexible link such as a chain or strap, said medallion being suspended on the central portion of said flexible link, one of the ends of the link being connected to one of the two flaps and the other end to the other flap, one of the connections being detachable.

7. A cape according to claim 1, wherein the surface of said back portion which is visible when placed on the wearer carries a system of hair cutting guide lines.

8. A cape according to claim 7 comprising a device for adjusting the position of the cape so that it extends perpendicular, permitting the cape to be maintained in a position where said system of guide lines can be used.

9. A cape according to claim 8, wherein the device for adjusting the position of the cape comprises reference marks carried by the back portion and which, in the configuration of use of the cape, must be contained in its vertical plane of symmetry and a plumb line which is attached to the upper part of the back portion and which, in said configuration of use, is also contained in the vertical plane of symmetry.

10. A cape according to claim 9, wherein the reference marks are constituted by the vertical median line of the back portion.

* * * * *